US010770842B2

(12) United States Patent
Jin et al.

(10) Patent No.: US 10,770,842 B2
(45) **Date of Patent: *Sep. 8, 2020**

(54) CONNECTOR WITH AN ELASTIC CLIP FOR A RADIATOR

(71) Applicant: Tyco Electronics (Shanghai) Co. Ltd., Shanghai (CN)

(72) Inventors: Jiwang Jin, Shanghai (CN); Hongqiang Han, Shanghai (CN); WenYu Liu, Shanghai (CN); Chenxi Wang, Shanghai (CN); Xingjie Ge, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

This patent is subject to a terminal disclaimer.

(21) Appl. No.: 16/351,644

(22) Filed: Mar. 13, 2019

(65) Prior Publication Data

US 2019/0288459 A1 Sep. 19, 2019

(30) Foreign Application Priority Data

Mar. 14, 2018 (CN) ..... 2018 1 0209943

(51) Int. Cl.

| | |
|---|---|
| ***H01R 13/426*** | (2006.01) |
| ***H01R 13/659*** | (2011.01) |
| ***H01R 13/6598*** | (2011.01) |
| ***H01R 13/6582*** | (2011.01) |
| ***H01R 13/6587*** | (2011.01) |

(52) U.S. Cl.

CPC ..... *H01R 13/6598* (2013.01); *H01R 13/426* (2013.01); *H01R 13/659* (2013.01); *H01R 13/6582* (2013.01); *H01R 13/6587* (2013.01)

(58) Field of Classification Search

CPC ..... H01R 13/6598; H01R 13/426; H01R 13/6582; H01R 13/6587; H01R 13/659; H01R 4/48; H01R 4/2483; H01R 9/037; H01R 9/16

See application file for complete search history.

(56) References Cited

U.S. PATENT DOCUMENTS 6,986,679 B1 * 1/2006 Aronson ..... H01R 25/00 439/170
7,601,021 B1 * 10/2009 Yang ..... H01R 13/65802 439/487
8,599,559 B1 * 12/2013 Morrison ..... H05K 9/0058 361/702

(Continued)

*Primary Examiner* — Edwin A. Leon
*Assistant Examiner* — Milagros Jeancharles
(74) *Attorney, Agent, or Firm* — Barley Snyder

(57) ABSTRACT

A connector comprises a cage having a plurality of insertion chambers arranged in parallel, a plurality of radiators each mounted on a top wall of one of the plurality of insertion chambers, and a plurality of elastic clips each adapted to fix one of the radiators on the top wall of one of the insertion chambers. Each clip has a pair of longitudinal beams and a pair of elastic lateral beams connected between the pair of longitudinal beams. The pair of elastic lateral beams cross the radiator in a lateral direction of the cage and press the radiator on the top wall of the insertion chamber. The pair of longitudinal beams are located at a pair of sides of the radiator opposite to each other in the lateral direction and are locked to the top wall of the insertion chamber.

19 Claims, 7 Drawing Sheets

(56) References Cited

U.S. PATENT DOCUMENTS

| | | | | |
|---|---|---|---|---|
| 8,823,540 | B2 * | 9/2014 | Scholeno | H01R 12/716 340/815.4 |
| 9,787,034 | B2 * | 10/2017 | Yang | G02B 6/0008 |
| 9,980,411 | B2 * | 5/2018 | Yang | H01L 23/4093 |
| 10,073,231 | B1 * | 9/2018 | Yang | H01L 23/00 |
| 10,446,960 | B2 * | 10/2019 | Guy Ritter | H01R 13/6594 |
| 2003/0161108 | A1 * | 8/2003 | Bright | G02B 6/4201 361/707 |
| 2004/0203289 | A1 * | 10/2004 | Ice | G02B 6/4277 439/607.2 |
| 2005/0195565 | A1 * | 9/2005 | Bright | H04B 1/036 361/688 |
| 2011/0317964 | A1 * | 12/2011 | Downs | G02B 6/4201 385/92 |
| 2014/0153192 | A1 * | 6/2014 | Neer | H05K 9/0058 361/704 |
| 2016/0308313 | A1 * | 10/2016 | Yang | G02B 6/0008 |
| 2019/0051580 | A1 * | 2/2019 | Liu | H01L 23/3672 |
| 2019/0230817 | A1 * | 7/2019 | Han | F28F 9/001 |
| 2019/0288448 | A1 * | 9/2019 | Liu | H01R 13/506 |
| 2019/0387644 | A1 * | 12/2019 | Liu | H05K 1/181 |
| 2020/0022283 | A1 * | 1/2020 | Han | H05K 7/20418 |

* cited by examiner

CONNECTOR WITH AN ELASTIC CLIP FOR A RADIATOR

CROSS-REFERENCE TO RELATED APPLICATION

This application claims the benefit of the filing date under 35 U.S.C. § 119(a)-(d) of Chinese Patent Application No. 201810209943.3, filed on Mar. 14, 2018.

FIELD OF THE INVENTION

The present invention relates to a connector and, more particularly, to a connector having a cage and a radiator mounted on the cage.

BACKGROUND

A high-speed photoelectric connector usually includes a shell (also referred to as a cage), an optical module received in the cage, a radiator mounted on the top wall of the cage, and an elastic clip for holding the radiator on the cage. The cage commonly has a plurality of insertion chambers arranged side by side. One radiator is mounted on the top wall of each insertion chamber and the elastic clip holds the radiator on the cage. The elastic clip has a pair of longitudinal beams extending along a longitudinal direction of the cage and a pair of lateral beams connected to two ends of the pair of longitudinal beams. A plurality of elastic pressing fingers are formed on each of the lateral beams. When the elastic clip is fixed on the top wall of the cage, the elastic pressing fingers on the lateral beams are pressed on both longitudinal ends of the radiator to hold the radiator on the cage.

In order to avoid interference of the elastic pressing fingers with the radiator, the radiator must have a large blank area without a heat dissipation column or fin receiving the elastic pressing fingers. This reduces the heat dissipation area and the service life of the connector. In addition, the length of the radiator is limited by the elastic clip and cannot be changed according to different heat dissipation requirements.

SUMMARY

A connector comprises a cage having a plurality of insertion chambers arranged in parallel, a plurality of radiators each mounted on a top wall of one of the plurality of insertion chambers, and a plurality of elastic clips each adapted to fix one of the radiators on the top wall of one of the insertion chambers. Each clip has a pair of longitudinal beams and a pair of elastic lateral beams connected between the pair of longitudinal beams. The pair of elastic lateral beams cross the radiator in a lateral direction of the cage and press the radiator on the top wall of the insertion chamber. The pair of longitudinal beams are located at a pair of sides of the radiator opposite to each other in the lateral direction and are locked to the top wall of the insertion chamber.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
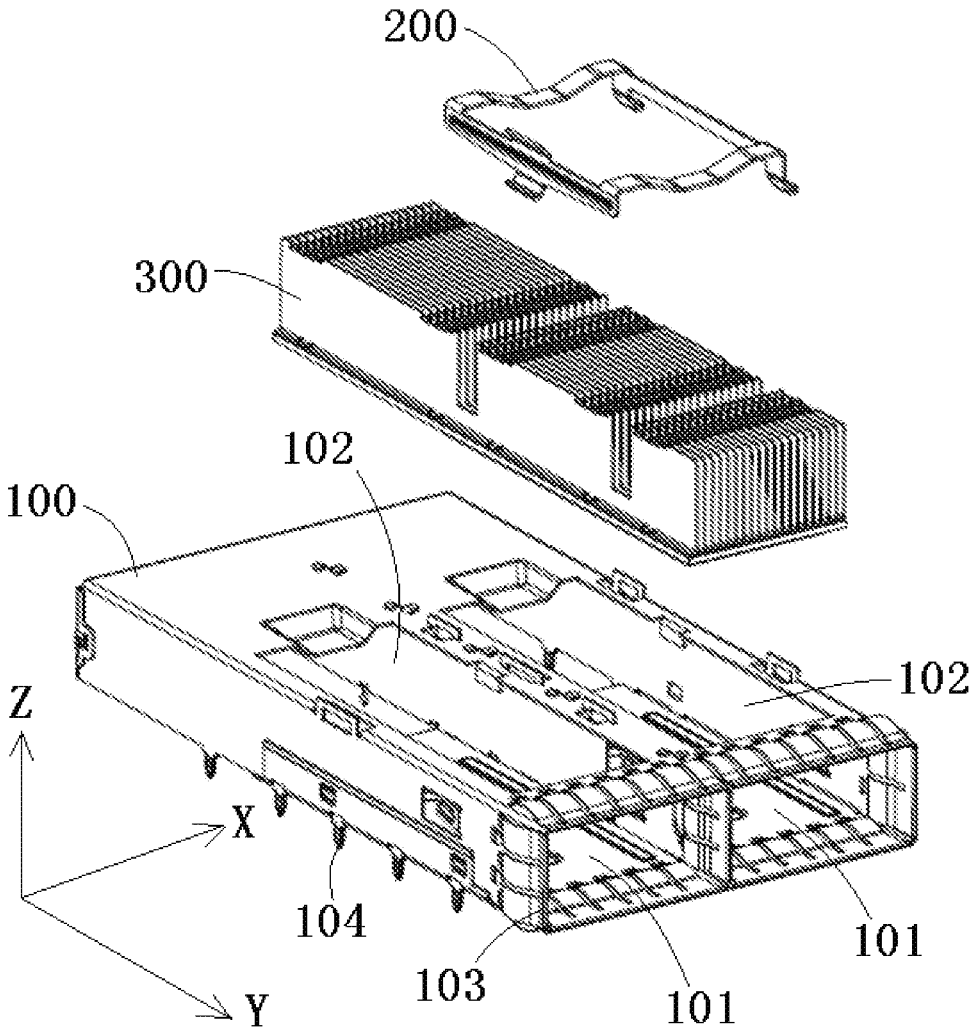
FIG. 1 is an exploded perspective view of a connector according to an embodiment.

Embodiments of the present disclosure will be described hereinafter in detail with reference to the attached drawings, wherein like reference numerals refer to like elements. The present invention may, however, be embodied in many different forms and should not be construed as being limited to the embodiment set forth herein; rather, these embodiments are provided so that the present disclosure will convey the concept of the invention to those skilled in the art.

A connector, as shown in FIGS. 1 and 5-7, comprises a cage 100, a plurality of radiators 300, and a plurality of elastic clips 200. The cage 100 has a plurality of insertion chambers 101 arranged parallel to each other. The plurality of radiators 300 are mounted on top walls of the plurality of insertion chambers 101. The plurality of elastic clips 200 are adapted to fix the plurality of radiators 300 on the top walls of the plurality of insertion chambers 101.

As shown in FIGS. 1-7, each clip 200 comprises a pair of longitudinal beams 210, 220 and a pair of elastic lateral beams 230, 240 connected between the pair of longitudinal beams 210, 220. The pair of elastic lateral beams 230, 240 are formed to cross the radiator 300 in a lateral direction X of the cage 100 to elastically press the radiator 300 on the top wall of the insertion chamber 101. The pair of longitudinal beams 210, 220 are located at both sides of the radiator 300 opposite each other in the lateral direction and locked to the top wall of the insertion chamber 101. A plurality of hooks 211, 221, 222 are formed on each of the longitudinal beams 210, 220 and a plurality of latches 111, 121, 122 are formed on the top wall of the insertion chamber 101. The plurality of hooks 211, 221, 222 and the plurality of latches 111, 121, 122 engage and are adapted to be locked with each other.

As shown in FIGS. 1-7, the pair of longitudinal beams 210, 220 comprise a first longitudinal beam 210 and a second longitudinal beam 220. The plurality of hooks 211, 221, 222 comprise a first hook 211 formed on the first longitudinal beam 210 and a second hook 221 and a third hook 222 each formed on the second longitudinal beam 220. The plurality of latches 111, 121, 122 comprise a first latch 111 engaged with the first hook 211 and a second latch 121 engaged with the second hook 221, and a third latch 122 engaged with the third hook 222.

Figure 2:
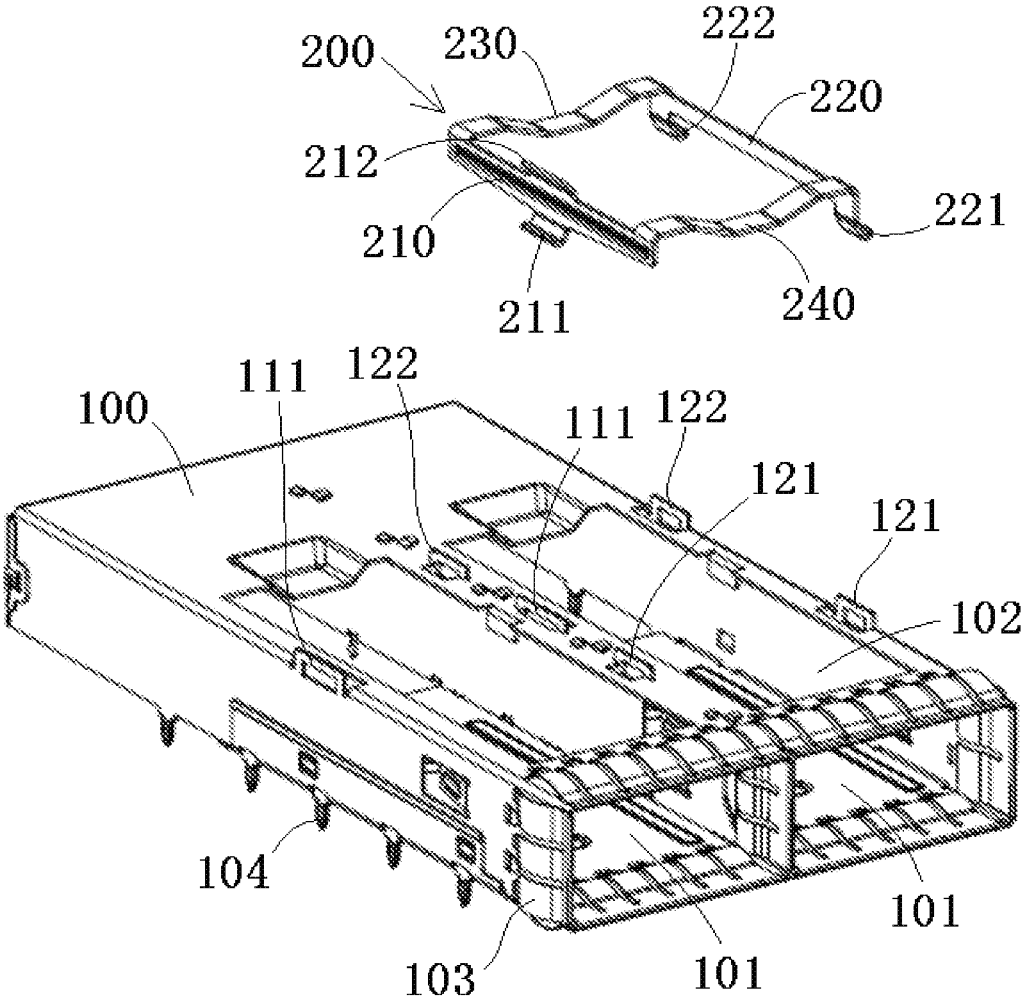
FIG. 2 is an exploded perspective view of a cage and an elastic clip of the connector of FIG. 1.
Figure 3:
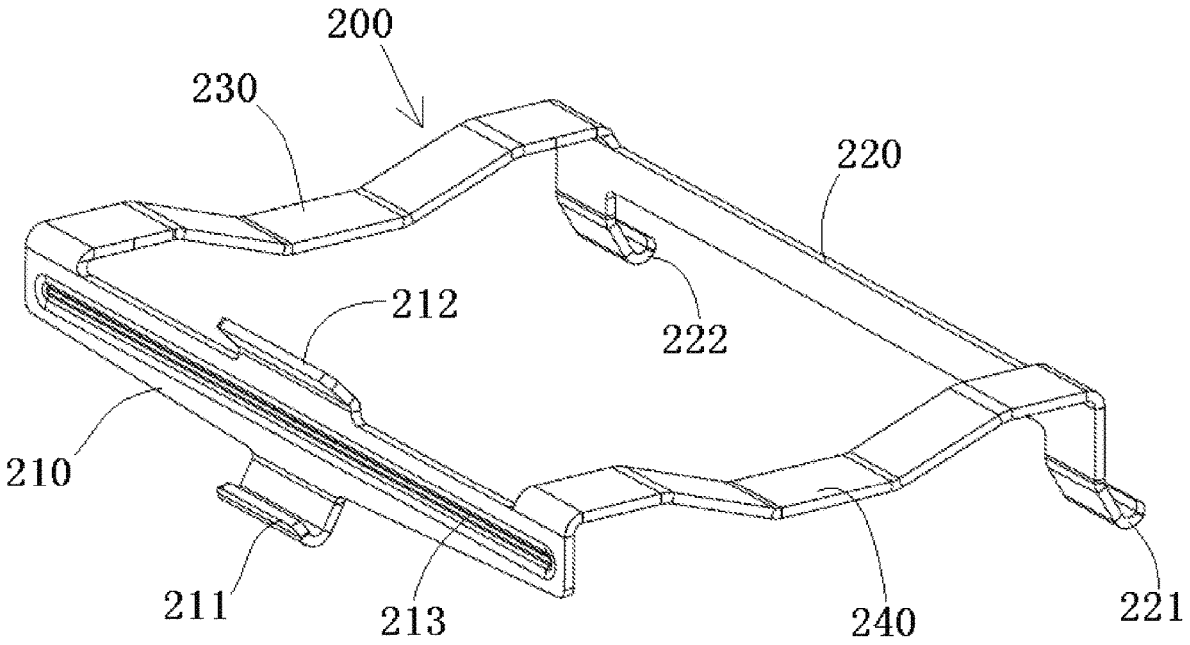
FIG. 3 is a perspective view of the elastic clip of the FIG. 2.
Figure 4:
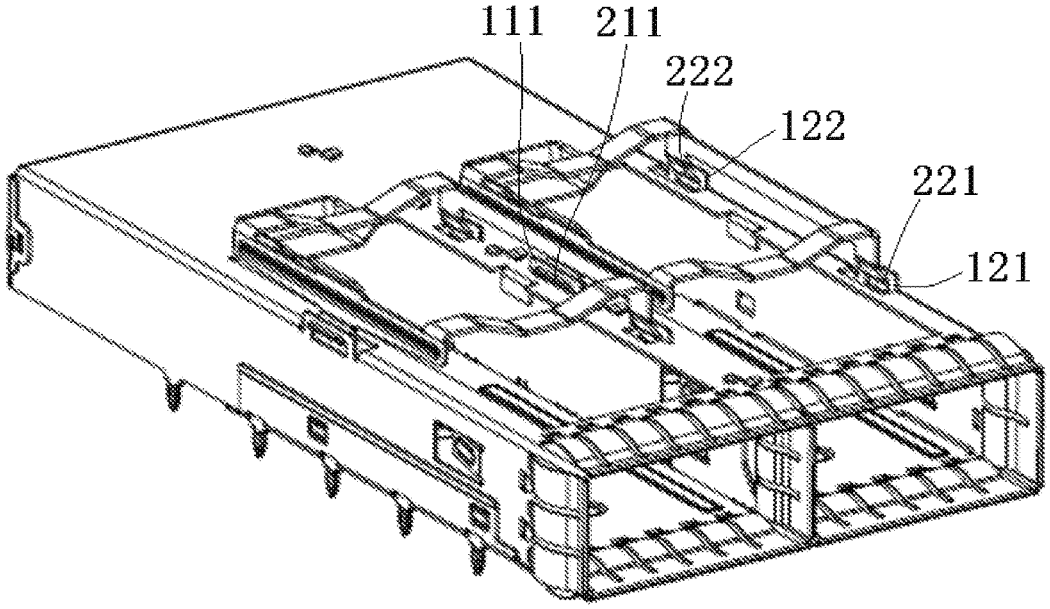
FIG. 4 is a perspective view of locking the elastic clip to the cage of FIG. 1.
Figure 5:
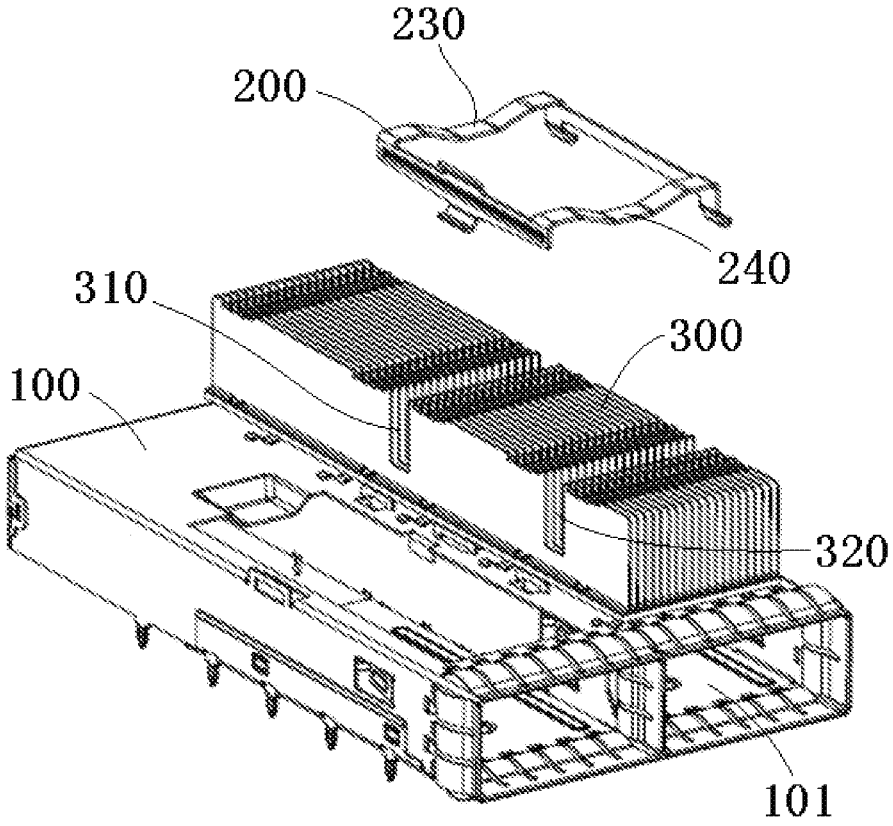
FIG. 5 is a partially exploded perspective view of a radiator to be mounted on a top wall of an insertion chamber of the cage with the elastic clip of FIG. 1.
Figure 6:
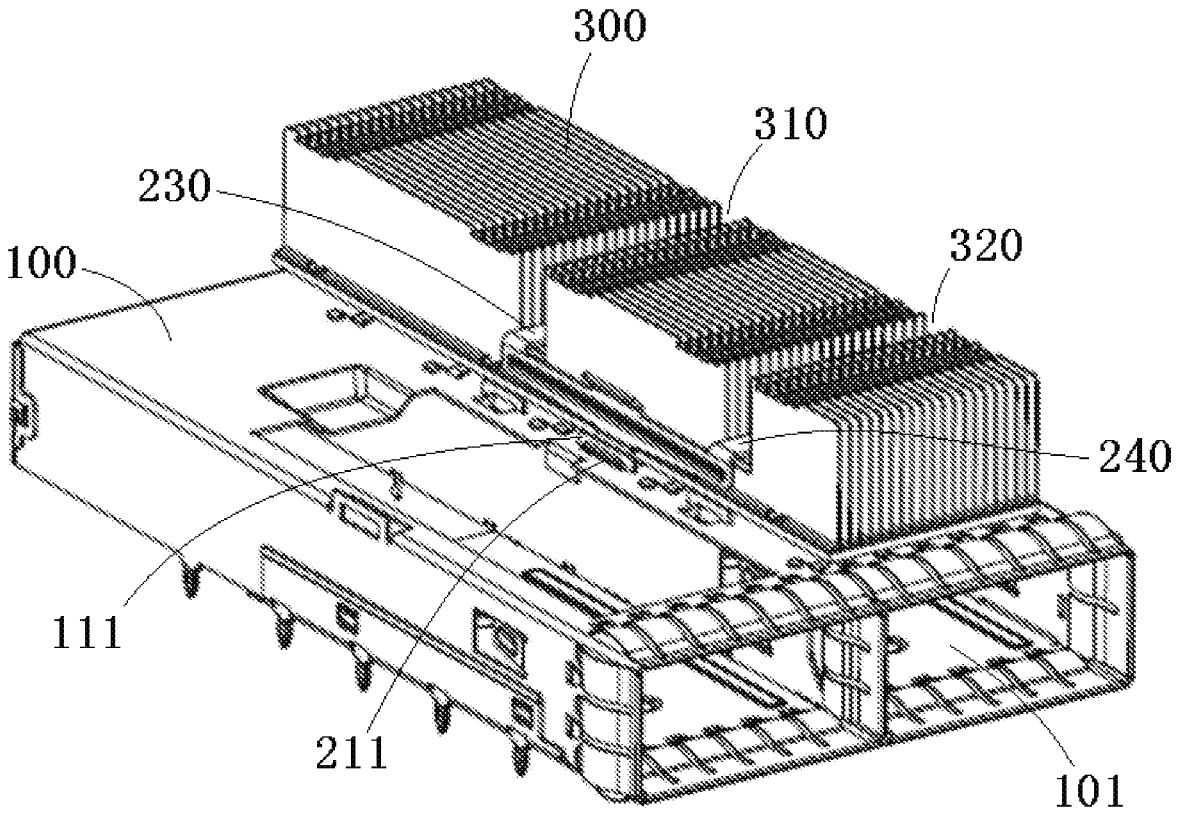
FIG. 6 is a perspective view of mounting one radiator on the top wall of one insertion chamber of the cage with one elastic clip of FIG. 1.
Figure 7:
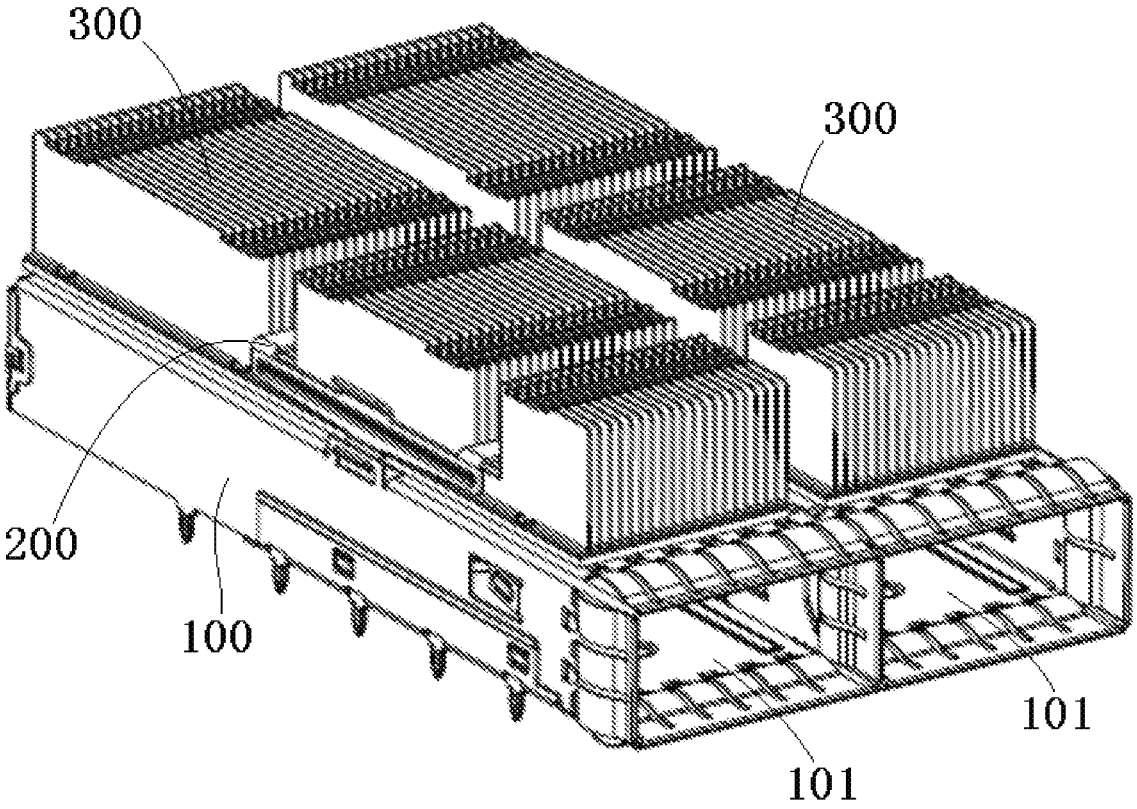
FIG. 7 is a perspective view of mounting two radiators on top walls of two insertion chambers of the cage with two elastic clips of FIG. 1.

As shown in FIGS. 2, 3, and 5, the first hook 211 is on the first longitudinal beam 210, and the second hook 221 and the third hook 222 are on the second longitudinal beam 220. The first hook 211 is located at a middle of the first longitudinal beam 210 in a length direction thereof. The second hook 221 and the third hook 222 are located at either ends of the second longitudinal beam 220 in the length direction.

As shown in FIGS. 1-7, at least one of a reinforcement rib 213 protrudes inward or outward and is formed on the first longitudinal beam 210. The reinforcement rib 213 extends from a first end of the first longitudinal beam 210 to a second end of the first longitudinal beam 210 along the length direction of the first longitudinal beam 210.

As shown in FIGS. 1-7, the first longitudinal beam 210 and the second longitudinal beam 220 are arranged to extend along a longitudinal direction (length direction) Y of the cage 100 and are perpendicular to the top wall of the cage 100. The first hook 211, the second hook 221, and the third hook 222 are connected to lower edges of the first longitudinal beam 210 and the second longitudinal beam 220.

As shown in FIGS. 1-7, the pair of elastic lateral beams 230, 240 comprise a first elastic lateral beam 230 connected between a pair of first ends of the first longitudinal beam 210 and the second longitudinal beam 220, and a second elastic lateral beam 240 connected between a pair of second ends of the first longitudinal beam 210 and the second longitudinal beam 220. The first elastic lateral beam 230 and the second elastic lateral beam 240 are connected to upper edges of the first longitudinal beam 210 and the second longitudinal beam 220.

As shown in FIGS. 1-7, a pressing tab 212 is formed on the first longitudinal beam 210 and connected to the upper edge of the first longitudinal beam 210 at the middle of the first longitudinal beam 210 in the length direction. The pressing tab 212 is inclined with respect to the top wall of the cage 100, so that the first hook 211 is moved in the lateral direction X and a height direction Z perpendicular to the top wall of the cage 100 by pushing the pressing tab 212.

As shown in FIGS. 3-5 and 7, the first hook 211 is on one of two adjacent elastic clips 200 located between and aligned with the second hook 221 and the third hook 222 on the other one of the two adjacent elastic clips in the longitudinal direction of the cage 200.

As shown in FIGS. 1, 3, and 5-7, the first elastic lateral beam 230 and the second elastic lateral beam 240 each have a curved shape which is bent downward. A first vertical slot 310, corresponding to the first elastic lateral beam 230, is formed in and traverses the radiator 300. A second vertical slot 320, corresponding to the second elastic lateral beam 240, is formed in and traverses the radiator 300. The first elastic lateral beam 230 and the second elastic lateral beam 240 are received in the first vertical slot 310 and the second vertical slot 320.

As shown in FIGS. 1-2, and 4-6, an opening 102 is formed in the top wall of the insertion chamber 101. The bottom of the radiator 300 protrudes through the opening 102 into the insertion chamber 101 to make physical contact with an optical module (not shown) inserted into the insertion chamber 101. As shown in FIGS. 1-2 and 4-7, the first latch 111, the second latch 121 and the third latch 122 are located at opposite sides of the opening 102 in the lateral direction X.

As shown in FIGS. 1-2 and 4-7, the connector further comprises an elastic electromagnetic shielding component 103 mounted on four walls of a port of the insertion chamber 101.

As shown in FIGS. 1-2 and 4-7, a plurality of pins 104, for inserting into holes formed in a circuit board (not shown), are formed on the bottom of the cage 100.

In another embodiment, the connector may further comprise an optical module adapted to be inserted into the insertion chamber 101 of the cage 100.

Figure 8:
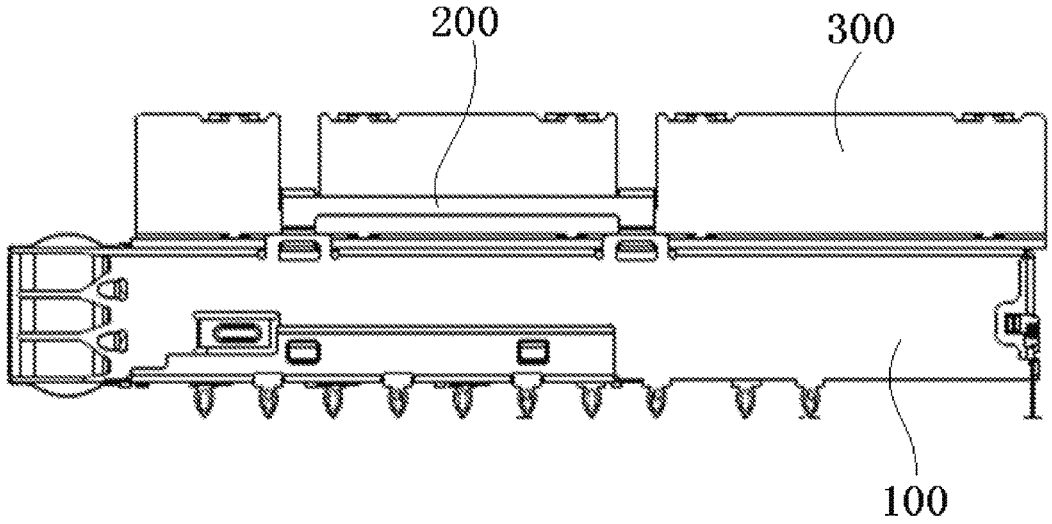
FIG. 8 is a side view of the connector of FIG. 7.
Figure 9:
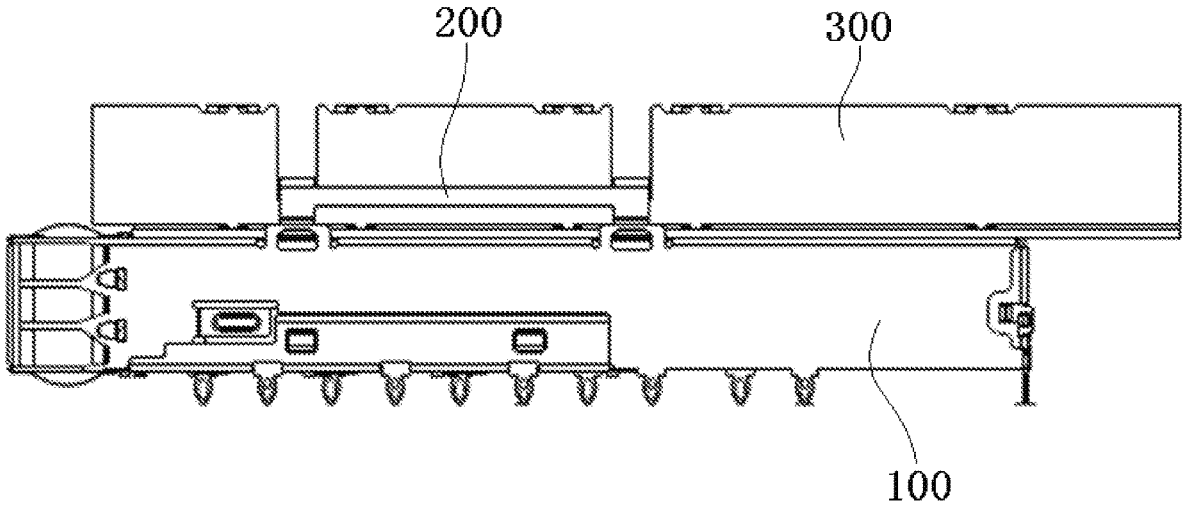
FIG. 9 is a side view of a connector according to another embodiment.

In the embodiment of the connector described above, the elastic clip 200 has decreased negative effect on the heat dissipation area of the radiator 300, which increases the heat dissipation area and prolongs the service life of the connector. The elastic clip 200 imposes less of a limitation on the length of the radiator 300, and the length of the radiator 300 may be changed according to different heat dissipation requirements. For example, compared with the connector shown in FIG. 8, the connector shown in FIG. 9 is lengthened to increase in the heat dissipation area of the radiator. As shown in FIG. 9, the length of the radiator 300 may be extended beyond the cage 100 in the longitudinal direction Y of the cage 100.

It should be appreciated for those skilled in this art that the above embodiments are intended to be illustrative, and not restrictive. For example, many modifications may be made to the above embodiments by those skilled in this art, and various features described in different embodiments may be freely combined with each other without conflicting in configuration or principle.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

As used herein, an element recited in the singular and proceeded with the word "a" or "an" should be understood as not excluding plural of said elements or steps, unless such exclusion is explicitly stated. Furthermore, references to "one embodiment" of the present disclosure are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

What is claimed is:

1. A connector, comprising:

a cage having a plurality of insertion chambers arranged in parallel;

a plurality of radiators each mounted on a top wall of one of the plurality of insertion chambers; and a plurality of elastic clips each adapted to fix one of the radiators on the top wall of one of the insertion chambers, each clip has a pair of longitudinal beams including a first longitudinal beam and a second longitudinal beam, and a pair of elastic lateral beams connected between the pair of longitudinal beams, the pair of elastic lateral beams cross the radiator in a lateral direction of the cage and press the radiator on the top wall of the insertion chamber, the pair of longitudinal beams are located at a pair of sides of the radiator opposite to each other in the lateral direction and are locked to the top wall of the insertion chamber, a first hook is formed on the first longitudinal beam and located at a middle of the first longitudinal beam in a length direction of the first longitudinal beam, a second hook and a third hook are formed on the second longitudinal beam and located at opposite ends of the second longitudinal beam in a length direction of the second longitudinal beam, and a pressing tab is formed on the first longitudinal beam and connected to an upper edge of the first longitudinal beam at the middle of the first longitudinal beam in the length direction.

2. The connector according to claim 1, wherein a plurality of latches are formed on the top wall of the insertion chamber, and the first, second and third hooks and the plurality of latches engage and are adapted to be locked with each other.

3. The connector according to claim 2, wherein the plurality of latches include a first latch engaged with the first hook, a second latch engaged with the second hook and a third latch engaged with the third hook.

4. The connector according to claim 3, wherein an opening is formed in the top wall of the insertion chamber, a bottom of the radiator protrudes through the opening into the insertion chamber to physically contact with an optical module inserted into the insertion chamber.

5. The connector according to claim 4, wherein the first latch, the second latch, and the third latch are located at opposite sides of the opening in the lateral direction.

6. The connector according to claim 1, wherein a reinforcement rib protruding inward or outward is formed on the first longitudinal beam and extends from a first end of the first longitudinal beam to a second end of the first longitudinal beam along the length direction of the first longitudinal beam.

7. The connector according to claim 1, wherein the first longitudinal beam and the second longitudinal beam extend along a longitudinal direction of the cage and are perpendicular to the top wall of the cage.

8. The connector according to claim 7, wherein the first hook, the second hook, and the third hook are connected to a lower edge of each of the first longitudinal beam and the second longitudinal beam.

9. The connector according to claim 8, wherein the pair of elastic lateral beams include a first elastic lateral beam connected between a pair of first ends of the first longitudinal beam and the second longitudinal beam and a second elastic lateral beam connected between a pair of second ends of the first longitudinal beam and the second longitudinal beam.

10. The connector according to claim 9, wherein the first elastic lateral beam and the second elastic lateral beam are connected to an upper edge of each of the first longitudinal beam and the second longitudinal beam.

11. The connector according to claim 9, wherein the first elastic lateral beam and the second elastic lateral beam each have a curved shape which is bent downward.

12. The connector according to claim 11, wherein a first vertical slot corresponding to the first elastic lateral beam is formed in and traverses the radiator and a second vertical slot corresponding to the second elastic lateral beam is formed in and traverses the radiator, the first elastic lateral beam is received in the first vertical slot and the second elastic lateral beam is received in the second vertical slot.

13. The connector according to claim 1, wherein the pressing tab is inclined with respect to the top wall of the cage, the first hook is moved in the lateral direction and a height direction perpendicular to the top wall of the cage by pushing the pressing tab.

14. The connector according to claim 1, further comprising an elastic electromagnetic shielding component mounted on a plurality of walls of a port of the insertion chamber.

15. The connector according to claim 1, wherein a bottom of the cage has a plurality of pins adapted to be inserted into a plurality of holes formed in a circuit board.

16. The connector according to claim 1, further comprising an optical module adapted to be inserted into one of the insertion chambers of the cage.

17. A connector comprising:

a cage having a plurality of insertion chambers arranged in parallel;

a plurality of radiators each mounted on a top wall of one of the plurality of insertion chambers; and a plurality of elastic clips each adapted to fix one of the radiators on the top wall of one of the insertion chambers, each clip has a pair of longitudinal beams including a first longitudinal beam and a second longitudinal beam, and a pair of elastic lateral beams connected between the pair of longitudinal beams, the pair of elastic lateral beams cross the radiator in a lateral direction of the cage and press the radiator on the top wall of the insertion chamber, the pair of longitudinal beams are located at a pair of sides of the radiator opposite to each other in the lateral direction and are locked to the top wall of the insertion chamber, a first hook is formed on the first longitudinal beam, and a second hook and a third hook are formed on the second longitudinal beam, wherein the first hook on one of a pair of adjacent elastic clips is located between and aligned with the second hook and the third hook on the other of the pair of adjacent elastic clips in a longitudinal direction of the cage.

18. The connector according to claim 17, wherein the first hook is located at a middle of the first longitudinal beam in a length direction of the first longitudinal beam, and the second hook and the third hook are located at opposite ends of the second longitudinal beam in a length direction of the second longitudinal beam.

19. The connector according to claim 17, wherein a pressing tab is formed on the first longitudinal beam and connected to an upper edge of the first longitudinal beam at the middle of the first longitudinal beam in the length direction.

* * * * *